US011203937B2

(12) United States Patent
Gross

(10) Patent No.: US 11,203,937 B2
(45) Date of Patent: Dec. 21, 2021

(54) BLADE FOR A TURBINE BLADE

(71) Applicant: Siemens Energy Global GmbH & Co. KG, Munich (DE)

(72) Inventor: Heinz-Jürgen Gross, Mulheim an der Ruhr (DE)

(73) Assignee: Siemens Energy Global GmbH & Co. KG, Munich (DE)

( * ) Notice: Subject to any disclaimer, the term of this patent is extended or adjusted under 35 U.S.C. 154(b) by 0 days.

(21) Appl. No.: 16/647,139

(22) PCT Filed: Sep. 19, 2018

(86) PCT No.: PCT/EP2018/075288
§ 371 (c)(1),
(2) Date: Mar. 13, 2020

(87) PCT Pub. No.: WO2019/057743
PCT Pub. Date: Mar. 28, 2019

(65) Prior Publication Data

US 2020/0277860 A1 Sep. 3, 2020

(30) Foreign Application Priority Data

Sep. 25, 2017 (DE) ..... 10 2017 216 926.5

(51) Int. Cl.
*F01D 5/18* (2006.01)

(52) U.S. Cl.
CPC ..... *F01D 5/186* (2013.01); *F05D 2240/303* (2013.01); *F05D 2240/304* (2013.01);
(Continued)

(58) Field of Classification Search
CPC .... F01D 5/186; F01D 5/187; F05D 2260/201; F05D 2260/22141; F05D 2260/205
See application file for complete search history.

(56) References Cited

U.S. PATENT DOCUMENTS 6,036,441 A * 3/2000 Manning ..... F01D 5/187 415/115
7,497,655 B1 3/2009 Liang
(Continued)

FOREIGN PATENT DOCUMENTS

DE 102016123525 A1 6/2017
EP 1584790 A2 10/2005
(Continued)

OTHER PUBLICATIONS

PCT International Search Report and Written Opinion of International Searching Authority dated Mar. 12, 2018 corresponding to PCT International Application No. PCT/EP2018/075288 filed Sep. 19, 2018.

*Primary Examiner* — Eldon T Brockman

(57) ABSTRACT

A blade for a turbine blade includes a suction-side side wall and a pressure-side side wall that enclose a cavity at least partially in a manner which extends along a profile centre line from a common front edge to a common rear edge and in a span width direction from a root-side end to a tip-side end. A first perforated impingement cooling wall which is provided with openings for the impingement cooling of the front edge and at least one further perforated impingement cooling wall for the impingement cooling of a section of the suction-side and/or pressure-side side wall are provided in the interior along the span width. The impingement cooling openings of the first impingement cooling wall and the at least one second impingement cooling wall are connected in series in terms of flow.

12 Claims, 3 Drawing Sheets

(52) U.S. Cl.
CPC .. *F05D 2250/185* (2013.01); *F05D 2260/201* (2013.01); *F05D 2260/202* (2013.01); *F05D 2260/22141* (2013.01)

(56) References Cited

U.S. PATENT DOCUMENTS

| | | | | |
|---|---|---|---|---|
| 8,070,442 | B1 * | 12/2011 | Liang | F01D 5/187 416/97 R |
| 10,024,171 | B2 * | 7/2018 | Itzel | F01D 9/065 |
| 2017/0167269 | A1 * | 6/2017 | Itzel | F01D 9/065 |

FOREIGN PATENT DOCUMENTS

| | | | |
|---|---|---|---|
| JP | 2002242607 | A | 8/2002 |
| JP | 2011111947 | A | 6/2011 |

* cited by examiner

BLADE FOR A TURBINE BLADE

CROSS REFERENCE TO RELATED APPLICATIONS

This application is the US National Stage of International Application No. PCT/EP2018/075288 filed 19 Sep. 2018, and claims the benefit thereof. The International Application claims the benefit of German Application No. DE 10 2017 216 926.5 filed 25 Sep. 2017. All of the applications are incorporated by reference herein in their entirety.

FIELD OF INVENTION

The invention relates to a blade for a turbine blade.

BACKGROUND OF INVENTION

A blade which corresponds to the preamble of the independent claim has been known for a very long time from the comprehensive available prior art. The blade and, in particular, also the entire gas turbine blade are as a rule produced in a precision casting method, with the result that there are cavities in the interior of the blade. Said cavities can be flowed through by a coolant, usually cooling air, in order that the metallic material of the blade and the turbine blade can withstand the high temperatures which occur during operation in the long term.

Different cooling concepts which have been known for a very long time are used for cooling, of which concepts one is called impingement cooling. In the case of said concept, cooling air jets impinge at an approximately perpendicular angle onto the inner faces of the metallic blade wall, in order to absorb the thermal energy contained therein and to subsequently transport it away with it. The impingement cooling walls which are required for the configuration of the impingement cooling can firstly be cast into said blade, or secondly can be provided by way of the installation of metallic sheet metal inserts. On account of the production, however, cast impingement cooling means require a minimum spacing between the wall face to be cooled and the impingement cooling wall which has the impingement cooling openings, since the casting cores which are required for this purpose themselves require a minimum wall thickness for a sufficient strength. If the perforated impingement cooling wall is mounted as an insert in a blade, further production and mounting steps are required which increase the complexity for the production of the turbine blade. Moreover, firstly leaks at the seam between the inserted impingement cooling insert and the cast component and secondly wear phenomena can occur, which can impair the cooling efficiency and/or the service life.

SUMMARY OF INVENTION

It is therefore an object of the invention to provide a blade for a turbine blade, which blade has a long service life and makes particularly efficient cooling of the side walls of the blade possible.

According to the invention, said object is achieved by way of a blade as claimed. Advantageous developments of the apparatus according to the invention are in each case the subject matter of dependent subclaims and the following description.

The present invention proposes that, in the case of a blade for a turbine blade, comprising a suction-side side wall and a pressure-side side wall which enclose a cavity at least partially in a manner which extends along a profile center line from a common leading edge to a common trailing edge and in a span width direction from a root-side end to a tip-side end, a first impingement cooling wall which is provided with impingement cooling openings for impingement cooling of the leading edge and at least one further impingement cooling wall which is also provided with impingement cooling openings for impingement cooling of a section of the suction-side and/or pressure-side side wall being provided along the span width in the interior, the impingement cooling openings of the first impingement cooling wall and the impingement cooling openings of the at least one second impingement cooling wall are connected in series in terms of flow. In other words: cascaded impingement cooling in the interior of the blade is proposed, at least one further impingement cooling section, advantageously two further impingement cooling sections, being connected downstream in a cascading manner per side wall on the leading edge on the suction side and/or pressure side, starting from a first impingement cooling means.

The invention is based on the finding that an impingement cooling means which is connected in series (cascaded impingement cooling) allows the cooling air to be utilized multiple times and therefore a homogenization of the temperature distribution along the cross section to be achieved. That region of the blade which is loaded thermally to the greatest extent, that is to say the region around the leading edge, is fed and impingement cooled with the coolest cooling air in a first impingement cooling section. During the first impingement cooling, the cooling air is heated for the first time, and the blade temperature in the vicinity of the leading edge is reduced to a tolerable level. The heated cooling air is subsequently conducted in a downstream section of the blade, and is used there again for impingement cooling of the side wall, as a result of which the temperature of the side wall there is likewise lowered and the cooling air is once again heated. In this way, an efficient use of cooling air is achieved, with the result that, in comparison with conventional blades, the cooling air which is saved can be used for increasing the efficiency of the gas turbine.

Because the heated cooling air achieves a lower cooling effect in following sections in a targeted manner, the thermal restriction over the blade cross section can be reduced. This can reduce the thermomechanical loading of the metallic blade, which can lead to an increased service life of the blade. On account of the fact that the impingement cooling means which is connected in series has small crossflow components in the span width direction, said impingement cooling means is comparatively efficient.

In accordance with a first particularly advantageous refinement of the invention, an impingement cooling space is provided between the relevant impingement cooling wall and the inner side of the associated side wall, a collection space being provided downstream of the relevant impingement cooling space, which collection space adjoins directly upstream of the downstream further impingement cooling wall. The relative terms "upstream" and "downstream" relate to the flow direction of the cooling air in the interior of the blade, unless stated otherwise. The collection spaces serve as cavities, in which the coolant which is heated further after an impingement cooling operation can firstly be collected, and from which secondly it can pass through the impingement cooling openings of the following impingement cooling wall for further impingement cooling. For the case where there are different throughflow cross sections locally as viewed along the span width on account of component tolerances, the collection spaces advantageously extend in the span width direction over the entire length of the blade. As a consequence, a homogenization of the pressure in the collection space can take place.

Further, a supply duct for feeding coolant for cooling the leading edge is provided between the first collection space and the first impingement cooling space. Said supply duct advantageously extends over the entire span width of the blade. Here, it can further advantageously taper in a manner which becomes more acute from its root-side end to the tip-side end, with the result that, under the precondition that the feeding of the coolant into the supply duct takes place at the root-side end, it has a greater throughflow cross section at the root-side end than at its tip-side end. This takes account of the fact that the coolant quantity which is present in the supply duct decreases with an increasing distance from the root-side end as a result of the presence of impingement cooling openings in the impingement cooling wall. Therefore, the conical shape of the supply duct leads to a homogenization of the flow speed of the coolant along the span width direction.

The collection space is further advantageously delimited partially by a projection which is impingement cooled. For this purpose, outlet openings which are close to the side wall are advantageously arranged in the rib. A homogenized temperature of the suction-side and/or pressure-side side wall along the blade profile, that is to say from the leading edge in the direction of the trailing edge, can be achieved by way of said configuration.

In accordance with a further advantageous refinement, in each case at least one further impingement cooling wall is provided on at least one side wall of the blade, advantageously on the two side walls. As a consequence, the suction-side impingement cooling and the pressure-side impingement cooling follow the first impingement cooling (the leading edge of the blade) in each case in series, the two further impingement cooling means which are arranged on both sides of the profile center line being connected in parallel, however, as viewed on their own.

Furthermore, it is particularly advantageous if, in accordance with a further refinement, one of the two further impingement cooling spaces is arranged on the suction side and the other one of the two further impingement cooling spaces is arranged on the pressure side, and a separate collection space is connected upstream of each of said two impingement cooling spaces. Said impingement cooling spaces can advantageously be provided by way of the provision of a first dividing rib. In this case, the pressures of the coolant which are required in the relevant collection spaces can be set in accordance with the local thermal loading of the suction-side and pressure-side side walls in such a way that an efficient and locally adapted use of coolants takes place here.

Moreover, it is advantageous if a further cavity is provided between two collection spaces which are arranged on both sides of the profile center line. Said further cavity is advantageously separated from the collection spaces by two second dividing ribs. Said cavity can be used firstly to reduce the size of the collection spaces to a desired dimension when a defined flow speed is to be achieved in the collection spaces. Secondly, the further cavity can also be used to conduct a further coolant from a tip-side end to a root-side end of the blade when said coolant is to be conducted merely through the blade as far as possible without absorbing thermal energy.

In order to avoid leakages of coolant within the blade, it is advantageous if said blade is of monolithic (that is to say, single-piece) configuration. Blades of this type can be produced, in particular, by means of an additive method. An additive method is understood to mean, in particular, what is known as SLM technology which is known as "Selective Laser Melting". This technology which is also called 3D printing technology makes it possible for comparatively small cavities and passage openings with exact dimensions to be produced for metallic components, in comparison with turbine blades which are produced in a conventionally cast manner.

Even if some terms are used in each case in the singular or in conjunction with a numeral in the description and/or in the patent claims, the scope of the invention for said terms should not be restricted to the singular or the respective numeral. Furthermore, the words "a" or "an" are not to be understood to be numerals, but rather indefinite articles.

The above-described properties, features and advantages of the invention and the manner in which they are achieved will be described in greater detail in a comprehensible manner in conjunction with the following description of the exemplary embodiments on the basis of the following figures.

BRIEF DESCRIPTION OF THE DRAWINGS

Here, the figures are shown in a merely diagrammatic manner, the consequence of which is, in particular, no restriction of the practicability of the invention.

In the figures.

DETAILED DESCRIPTION OF INVENTION

In the following text, the technical features which are provided with identical designations are those which have the same technical effect.

Figure 1:
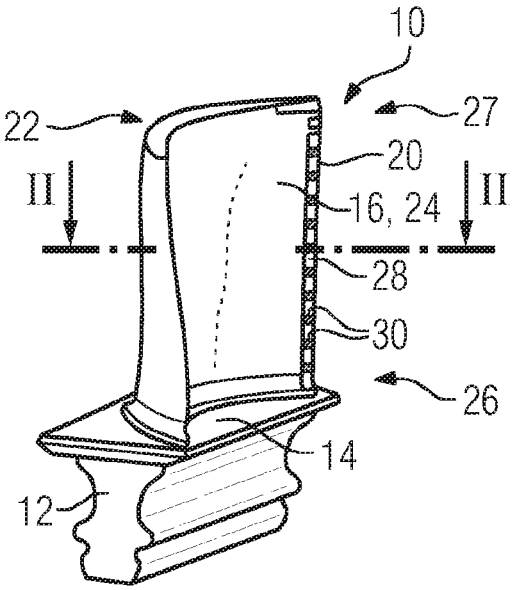
FIG. 1 shows a turbine blade in a perspective diagrammatic illustration.

A turbine blade 10 which relates to the invention is shown in a perspective illustration in FIG. 1. The turbine blade 10 is configured as a rotor blade according to FIG. 1. The invention can also be used in a guide vane (not shown) of a guide blade. The turbine blade 10 comprises a blade root 12 which is shaped like a Christmas tree in cross section, and a platform 14 which is arranged on said blade root 12. The platform 14 is adjoined by a blade 16 which is curved aerodynamically. It is irrelevant for the invention whether the blade 16 is coated by a thermal protective layer or not. The blade 16 comprises a suction-side wall 22 and a pressure-side wall 24 which, in relation to a hot gas which flows around the blade 16, extend from a leading edge 18 to a trailing edge 20. A multiplicity of openings 28 for ejecting coolant are provided along the trailing edge 20, which openings 28 are separated from one another by way of webs 30 which are arranged in between. The blade 16 extends along a span width direction from a root-side end 26 to a tip-side end 27. In the case of a use of the illustrated turbine blade 10 in an axial flow gas turbine, the span width direction coincides with the radial direction of the gas turbine.

Figure 2:
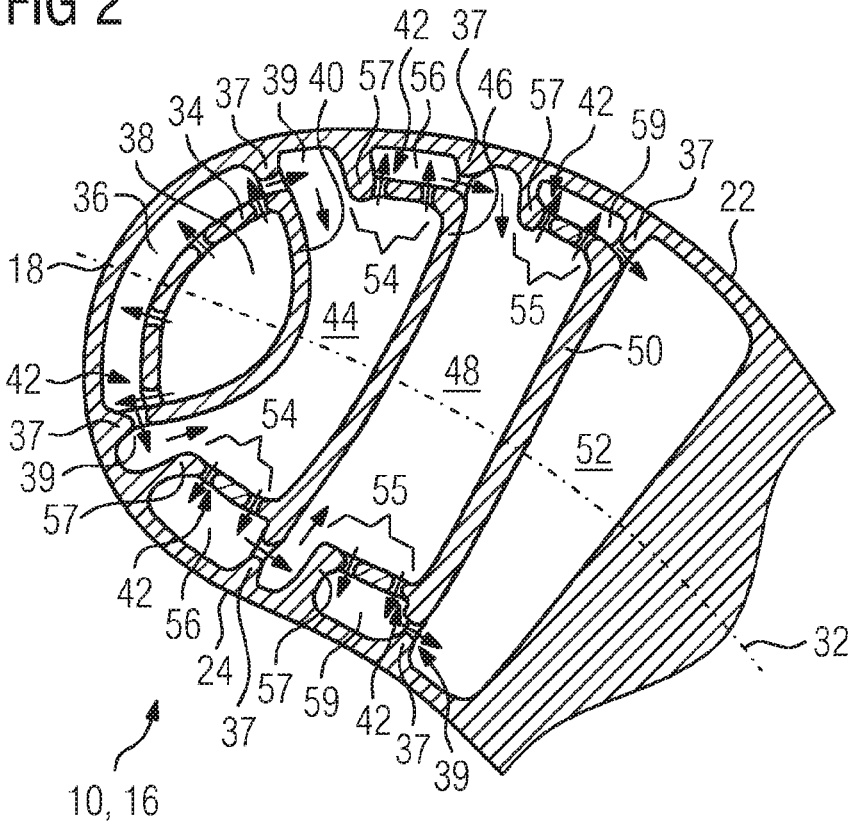
FIG. 2 shows the cross section according to the sectional line II-II through the blade of the turbine blade according to FIG. 1 as a first exemplary embodiment.
Figure 3:
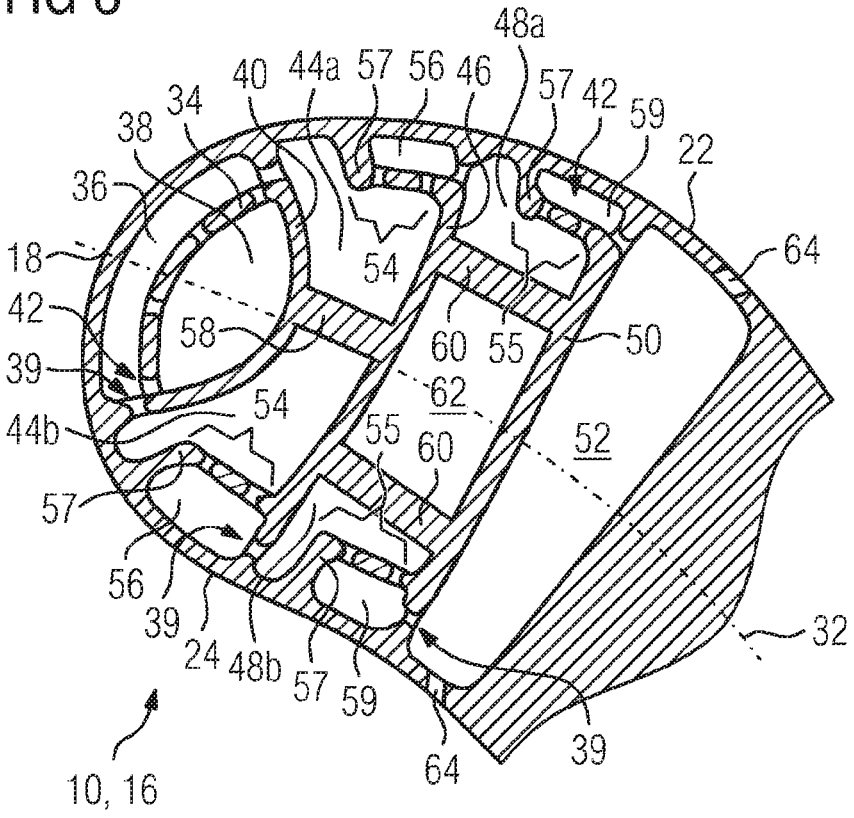
FIG. 3 shows a second exemplary embodiment of a blade according to the invention of a turbine blade.

FIG. 2 shows a sectional illustration through the blade 16 in accordance with the sectional line II-II as a first exemplary embodiment of a blade 16 according to the invention, whereas FIG. 3 shows a second exemplary embodiment thereof. Both the figures show merely the leading edge-side region (in relation to the hot gas of the gas turbine) of the blade 16, and the rear part and the trailing edge of the blade 16 cannot be seen. As has already been explained, the blade 16 and its pressure-side side wall 24 and suction-side side wall 22 extend, starting from the leading edge 18, along a profile center line 32 to the trailing edge. A first perforated (that is to say, provided with impingement cooling openings 42) impingement cooling wall 34 is arranged in the interior of the blade 16 at a spacing from the inner face of the leading edge 18, with the result that a first impingement cooling space 36 is configured in between. A supply duct 38 is provided on that side of the first impingement cooling wall 34 which lies opposite the first impingement cooling space 36. This is separated from the remaining cavity of the blade 16 by way of a first rib 40. In accordance with the cross-sectional plane, the first rib 40 extends from a suction-side rib end 37 to a pressure-side rib end 37, and has outlet openings 39 which are close to the side wall for the first impingement cooling space 36.

In accordance with the exemplary embodiment which is shown, four impingement cooling openings 42 which lie in the sectional plane are provided in the first impingement cooling wall 34 for full surface cooling of the leading edge 18 and the suction-side and pressure-side regions of the side walls 22, 24 which adjoin it directly.

As viewed along the profile center line 32 in the direction of the trailing edge, the first rib 40 is followed by a first collection space 44 which is separated from a second collection space 48 by way of a second rib 46. Said second collection space 48 is likewise delimited by way of a third rib 50, with the result that a third collection space 52 adjoins further in the direction of the trailing edge. The first collection space 44 is delimited both on the suction side and on the pressure side by two further impingement cooling walls 54. Impingement cooling openings 42 are also arranged in said impingement cooling walls 54, with the result that first further impingement cooling spaces 56 are provided, by way of which corresponding sections of the suction-side and pressure-side side walls 22 and 24 can be impingement cooled. Second further impingement cooling spaces 59 are separated from the second collection space 48 by way of impingement cooling walls 55.

In accordance with the exemplary embodiment which is shown, all further impingement cooling spaces 56, 59 are delimited laterally by way of projections 57 which extend toward the inside from the side walls 22, 24. In an analogous manner with respect to the first rib 40, the second and third ribs 46, 50 merge at their rib ends 37 into the suction-side and pressure-side side wall 22, 24 and have outlet openings 39 there which are close to the side wall.

On account of the selected arrangement of collection spaces 44, 48, 52, impingement cooling walls 34, 54, impingement cooling spaces 36, 56, outlet openings 39 and projections 57, it is clear that the coolant is used multiple times in an impingement cooling manner both on the suction side and on the pressure side in a plurality of impingement cooling arrangements which are connected one after another, in order to reduce the temperatures of the blade walls 22, 24 to a desired level.

It goes without saying that there are not only the impingement cooling openings 42 and outlet openings 39 which are shown, but rather further ones of this type are distributed along the span width in the corresponding walls at the corresponding position, advantageously so as to lie in a row.

In detail, during operation, a coolant is fed to the supply duct 38 through an opening (not shown) of the turbine blade 10. There, it is distributed over the span width of the blade and flows through the individual impingement cooling openings 42 of the first impingement cooling wall 34 in a manner which forms air jets. The air jets impinge in a known manner on the inner face of the leading edge and cool the latter as intended. Subsequently, the coolant flows through the outlet openings 39 of the first rib 40, after which it comes into contact with the projections 57 in an impingement cooling manner, and is deflected by said projections 57 into the first collection space 44. From there, it flows through the first and second further impingement cooling walls 54, 55 in order to cool the associated side wall sections. From the first and second impingement cooling spaces 56, 59, it passes through the outlet openings of the ribs 46, 50 into the following collection spaces 48, 52.

After the coolant has flowed through the above-described cascaded impingement cooling arrangement, it passes into the collection space 52. From there, the coolant can be used in a known way for cooling further sections of the blade 16. It is conceivable that it is firstly deflected into a type of serpentine cooling system, and is subsequently ejected through the trailing edge openings 28. It is likewise possible that the coolant is conducted toward the outside from the interior of the blade 16 through film cooling openings (64, FIG. 3) which are arranged in the side walls 22, 24. The combination of the two variants can also be technically appropriate.

FIG. 3 shows an alternative refinement of the turbine blade 10 according to the invention as a second exemplary embodiment. In an analogous manner with respect to FIG. 2, the identical features in FIG. 3 are provided with identical designations, with the result that merely the differences with respect to the first exemplary embodiment will be described in the following text.

In comparison with the first exemplary embodiment, dividing ribs 58, 60 are provided in the interior of the blade 16. A first dividing rib 58 extends between the rib 40 and the further rib 46 along the profile center line 32. The dividing rib 58 divides the collection space 44 into two collection spaces 44*a* and 44*b*, of which the first-mentioned is provided on the suction side and the second-mentioned is provided on the pressure side. Two second dividing ribs 60 extend along and therefore, as it were, parallel to the profile center line 32 between the rib 46 and the rib 50, in each case one of them being arranged on the suction side and one of them being arranged on the pressure side, however.

In the same way as the first dividing rib 58 divides the collection space 44, the collection space 48 from FIG. 2 is then divided into two collection spaces 48*a* and 48*b*, it being possible for a further cavity 62 to be provided, however, on account of the use of two second dividing ribs 60. The further cavity 62 can be used for different purposes. For example, it is suitable for conducting a part of the coolant from the root-side end 26 of the blade 16 to a tip-side end 27 of the blade 16, without said coolant coming into contact with the comparatively hot side walls 22, 24. Therefore, comparatively cool cooling air can be provided at the tip-side end 27 of the blade, which is advantageous, in particular, in the case of guide blades. It is likewise conceivable that the cavity 62 is closed hermetically, in order to conduct the cooling air which is guided in the part collection spaces 48*a*, 48*b* closer to the impingement cooling walls 54 and the impingement cooling openings 42 which are arranged therein.

The features which are described in the relevant exemplary embodiments and are specified in the dependent claims can be combined with one another in any desired way.

Overall, as a consequence, the invention relates to a blade 16 for a turbine blade 10, comprising a suction-side side wall 22 and a pressure-side side wall 24 which enclose a cavity at least partially in a manner which extends along a profile center line 32 from a common leading edge 18 to a common trailing edge 20 and in a span width direction from a root-side end 26 to a tip-side end 27, a first perforated impingement cooling wall 34 which is provided with openings for impingement cooling of the leading edge 18 and at least one further perforated impingement cooling wall 54 for impingement cooling of a section of the suction-side and/or pressure-side side wall 22, 24 being provided along the span width in the interior. In order to achieve particularly efficient cooling of the turbine blade, it is proposed that the impingement cooling openings 42 of the first impingement cooling wall 34 and of the at least one second impingement cooling wall 54 are connected in series in terms of flow.

The invention claimed is:

1. A blade for a turbine blade, comprising:

a suction-side side wall and a pressure-side side wall which enclose a cavity at least partially in a manner which extends along a profile center line from a common leading edge to a common trailing edge and in a span width direction from a root-side end to a tip-side end, a first impingement cooling wall which is provided with impingement cooling openings for impingement cooling of the leading edge and at least one further impingement cooling wall which is also provided with impingement cooling openings for impingement cooling of a section of the suction-side side wall and/or the pressure-side side wall being provided along the span width in an interior, wherein the impingement cooling openings of the first impingement cooling wall and the impingement cooling openings of the at least one further impingement cooling wall are connected in series in terms of flow, a rib that extends from the suction-side side wall to the pressure-side side wall, wherein the rib connects to at least one end of the first impingement cooling wall at a connection that is close to at least one of the suction-side side wall and the pressure-side side wall, and an outlet opening arranged in the rib between the connection and the at least one of the suction-side side wall and the pressure-side side wall.

2. The blade as claimed in claim 1, further comprising:

a first impingement cooling space between the first impingement cooling wall and an inner side of the leading edge and inner sides of the suction-side side wall and the pressure-side side wall that adjoin the leading edge.

3. The blade as claimed in claim 2, further comprising:

a first collection space downstream of the first impingement cooling space, wherein the first collection space adjoins directly upstream of the at least one further impingement cooling wall.

4. The blade as claimed in claim 3, further comprising:

a supply duct between the first collection space and the first impingement cooling space.

5. The blade as claimed in claim 3, further comprising:

a projection that extends from the at least one of the suction-side side wall and the pressure-side side wall, wherein the first collection space is delimited partially by the projection which is impingement cooled by the outlet opening.

6. The blade as claimed in one of claim 1, wherein the at least one further impingement cooling wall is arranged on the at least one of the suction-side side wall and the pressure-side side wall of the blade, or on both the suction-side side wall and the pressure-side side wall.

7. The blade as claimed in claim 6, further comprising:

two further impingement cooling spaces, wherein one of the two further impingement cooling space is arranged between the at least one further impingement cooling wall and an inner side of the suction-side side wall and the other one of the two further impingement cooling spaces is arranged between the at least one further impingement cooling wall and an inner side of the pressure-side side wall, and wherein a collection space is provided upstream of the at least one further impingement cooling wall.

8. The blade as claimed in claim 7, wherein the collection space is divided by a dividing rib into two separate collection spaces.

9. The blade as claimed in claim 7, wherein the collection space is divided by two dividing ribs into two separate collection spaces, and wherein a further cavity is provided between the two separate collection spaces which are arranged on both sides of the profile center line.

10. The blade as claimed in claim 1, wherein the blade is monolithic.

11. The blade as claimed in claim 10, wherein the blade is produced by means of an additive method.

12. A turbine blade comprising:

a blade as claimed in claim 1.

* * * * *